US012599218B2

(12) United States Patent
Yue et al.

(10) Patent No.: US 12,599,218 B2
(45) Date of Patent: Apr. 14, 2026

(54) COSMETIC APPLICATOR

(71) Applicant: Fengrui Industrial (Huaian) Co., Ltd, Huaian Jiangsu (CN)

(72) Inventors: Ma Yue, Huaian (CN); Rebecca Louise Goswell, Richmond (GB); Brian Edward McNamara, Poole (GB)

(73) Assignee: FENGRUI INDUSTRIAL (HUAIAN) CO., LTD., Huaian (CN)

( * ) Notice: Subject to any disclaimer, the term of this patent is extended or adjusted under 35 U.S.C. 154(b) by 0 days.

(21) Appl. No.: 19/008,127

(22) Filed: Jan. 2, 2025

(65) Prior Publication Data

US 2025/0234978 A1 Jul. 24, 2025

(30) Foreign Application Priority Data

Jan. 18, 2024 (CN) ..... 202420130344.3

(51) Int. Cl.
*A46B 11/00* (2006.01)
*A45D 34/04* (2006.01)

(52) U.S. Cl.
CPC ..... *A45D 34/045* (2013.01)

(58) Field of Classification Search
CPC .. A45D 34/042; A45D 34/045; A45D 40/262; A46B 2200/106
USPC ..... 401/130
See application file for complete search history.

(56) References Cited

U.S. PATENT DOCUMENTS

| | | | | |
|---|---|---|---|---|
| 9,498,047 | B2 * | 11/2016 | Uresti | A46B 3/005 |
| 10,888,145 | B2 * | 1/2021 | Kukreja | A45D 40/265 |
| 12,310,484 | B2 * | 5/2025 | Bianco | A45D 40/262 |
| 2009/0114239 | A1 | 5/2009 | Chen | |
| 2010/0212097 | A1 * | 8/2010 | Jeong | A45D 34/042 15/207.2 |
| 2013/0032166 | A1 | 2/2013 | Kim | |
| 2020/0367631 | A1 | 11/2020 | Bianco | |
| 2021/0093068 | A1 * | 4/2021 | Saito | A46B 9/021 |

FOREIGN PATENT DOCUMENTS

CN 215532386 U 1/2022

OTHER PUBLICATIONS

Extended European Search Report dated Jun. 12, 2025 for corresponding European Application No. 24220825.4.

* cited by examiner

*Primary Examiner* — Jennifer C Chiang
(74) *Attorney, Agent, or Firm* — Chrisman Gallo Tochtrop LLC

(57) ABSTRACT

A cosmetic applicator (101) includes a mounting rod (1) and an applicator device (2) arranged at an end (11) of the mounting rod (1). The applicator device has a first applicator element (21) and a second applicator element (22). The first applicator element (21) includes a first material, and the second applicator element (22) includes a second material. The first material has a hardness lower than the hardness of the second material. The first applicator element (21) and the second applicator element (22) are fixed on the end (11) of the mounting rod (1) at different sides of the mounting rod.

10 Claims, 14 Drawing Sheets

COSMETIC APPLICATOR

TECHNICAL FIELD

The present invention relates on the cosmetic applicator field.

TECHNICAL BACKGROUND

Some cosmetics, such as lip glaze and lip gloss, need to be used with an applicator device. With the continuous improvement of people's living standards, users not only pay more attention to the makeup rendering, but also pay more attention to the "application's touch". However, the existing applicator device offers no possibility of adaptation makeup rendering and the "application's touch", the user having to stick to the application rendering obtained with the provided applicator. Such provided applicator can clearly not meet the requirements of users' diverse makeup experience and it would be interesting to provide cosmetic applicator that allow the user to adapt the makeup experience to its need.

CONTENT OF INVENTION

The present application aims to provide a new cosmetic applicator.

To achieve the above purposes, the technical scheme adopted by the utility model is:

A cosmetic applicator comprising:

a mounting rod and, a applicator device arranged at an end of the mounting rod, the applicator device comprising a first applicator element having a first applicator surface for applying cosmetic products and a second applicator element having a second applicator surface for applying cosmetic products, the first applicator surface being opposite to the second applicator element and the second applicator surface being opposite to the second applicator element, the first applicator element including a first material and the second applicator element including a second material, the first material having a hardness lower than the hardness of the second material, and wherein the first applicator element and the second applicator are fixed on the end of the mounting rod at different sides of the mounting rod.

Preferably, the first material is a flexible material whereas the second material is a rigid material, and the first applicator element is integral with the end of the mounting rod.

Preferably, the first material is a flexible material whereas the second material is a rigid material, and the first applicator element being removably mounted on the end of the mounting rod.

Preferably, the end of the mounting rod includes a through opening and the first applicator element and the second applicator are at least partially arranged in the through opening and are connected by a connection structure passing through the through opening.

Preferably, the connection structure includes connection column and a connection aperture, the first applicator element including one of the connection column and the connection aperture and the second applicator including the other of the connection column and the connection aperture, wherein the connection column is inserted into the connection aperture.

Preferably, the first material is a flexible material, and the first applicator element includes the connection aperture the second material being a rigid material, and the second applicator element including connection column, an end of the connection column including a connecting head, a diameter of the connecting head being greater than a diameter of the connection column and a diameter of the connection aperture, and wherein the connection column extends through the connection aperture with the connecting head arranged on the side of the first applicator element opposite to the rest of the second applicator element.

Preferably, the first applicator element includes a first substrate, the connection aperture being provided through the first substrate, a first applicator pattern being arranged on the first substrate opposite to the second applicator element, the first applicator pattern forming the first applicator surface for applying cosmetic products, wherein the connecting head is recessed and spaced from the first applicator pattern.

Preferably, a side of the first substrate has a first arc surface which is hollowed-out, the first applicator pattern extending from the first arc surface in direction opposite from the first substrate, and/or one side of the second substrate has a second arc surface protruding in an outside direction from the second substrate, the second applicator pattern extending from the second arc surface in direction opposite from the second substrate, the second applicator pattern including a plurality of intervals arranged along a length direction of the second applicator element.

Preferably, the first applicator element includes a first substrate, a side of the first substrate having a first arc surface which is hollowed-out, the first applicator element further including at least a first applicator pattern extending from the first arc surface in direction opposite from the first substrate, and/or second applicator element includes a second substrate, one side of the second substrate having a second arc surface protruding in an outside direction from the second substrate, the second applicator element further including a second applicator pattern extending from the second arc surface in direction opposite from the second substrate, the second applicator pattern including a plurality of intervals arranged along a length direction of the second applicator element.

Preferably, at least a part of the first applicator element extends outside the through opening and protrudes away from a first exterior surface of the end of the mounting rod, and at least a part of the first applicator element extending outside the through opening and protrudes away from a second exterior surface of the end of the mounting rod.

Preferably the first applicator element is removably connected to the second applicator element.

Preferably, the first applicator element has a first plane oriented toward the second applicator element, the second applicator having a second plane oriented toward the first applicator element, a first applicator surface and the first plane being arranged on two sides of the first applicator element relative to a thickness direction of the first applicator element, and the second applicator surface and the second plane being arranged on two sides of the second applicator element relative to a thickness direction of the second applicator element, the first plane and the second plane being complementary in shape.

Due to the application of the technical scheme, the present invention has the following advantages compared with the prior art: The cosmetic applicator according to the invention could be provided with two kinds of applicator element with different hardness, which enrich the function of the applicator and the user's use experience. When using the applicator, the two applicators do not interfere with each other, and the user can choose the suitable applicator according to different makeup needs, and hold the mounting rod to apply cosmetics.

The invention also relates on a cosmetic packaging containers comprising:

a cosmetic applicator according to the invention, and a bottle body intended to accommodate a cosmetic product.

DESCRIPTION OF THE DRAWINGS the present invention will be better understood on reading the description of exemplary embodiments, given for purely indicative purposes and in no way limiting, with reference to the appended drawings in which.

Identical, similar or equivalent parts of different figures bear the same numerical references so as to facilitate the passage from one figure to another.

The different parts represented in the figures are not necessarily on a uniform scale, in order to make the figures more readable.

The different possibilities (alternatives and embodiments) must be understood as not being mutually exclusive and can be combined with each other.

DETAIL DESCRIPTION OF SOME EMBODIMENTS OF THE INVENTION

The scope of the present application is further elaborated in combination with the attached drawings and specific embodiments.

Figure 1:
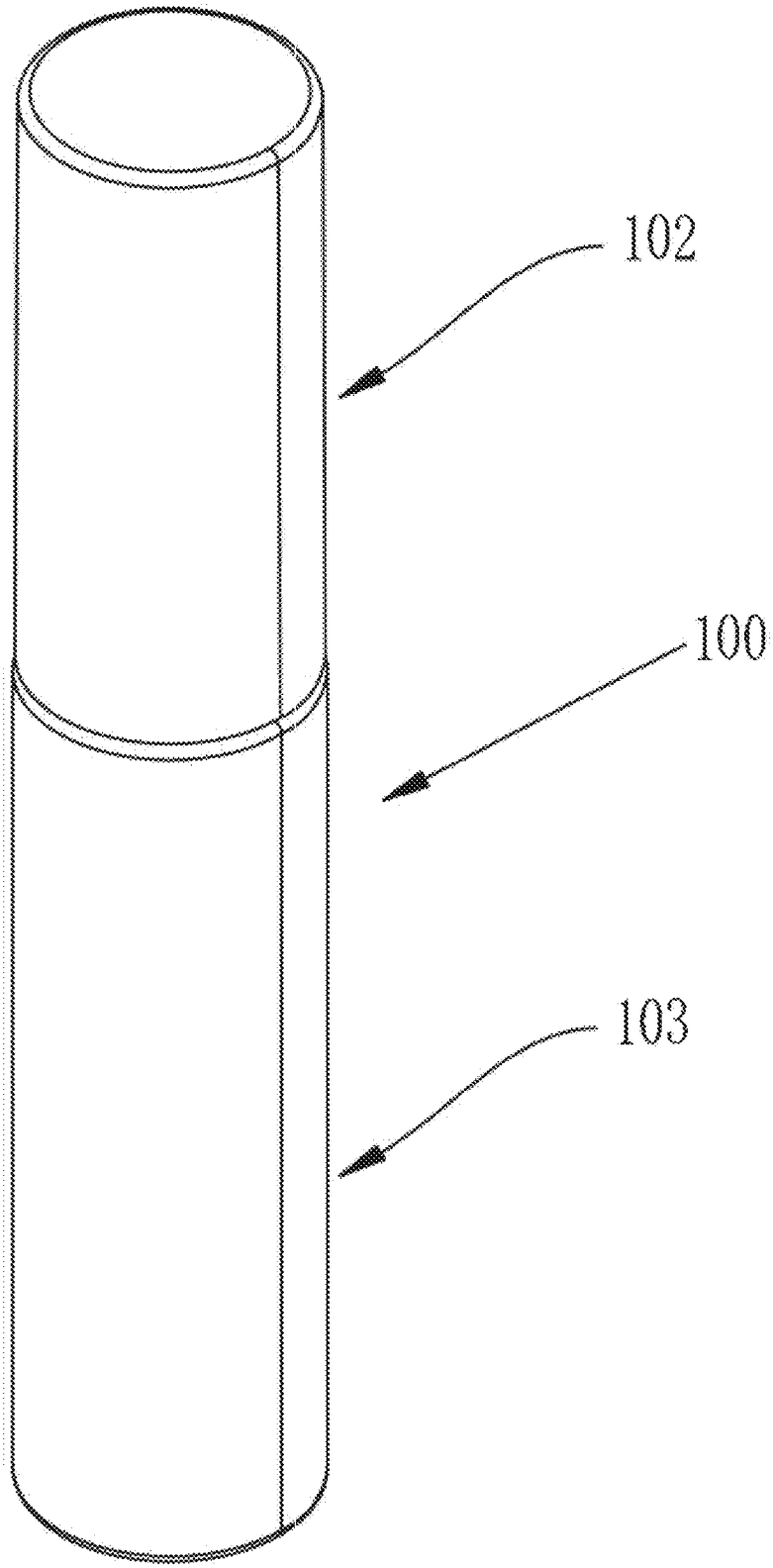
FIG. 1 is a three-dimensional view of a cosmetic packaging container of a specific embodiment of the invention.
Figure 2:
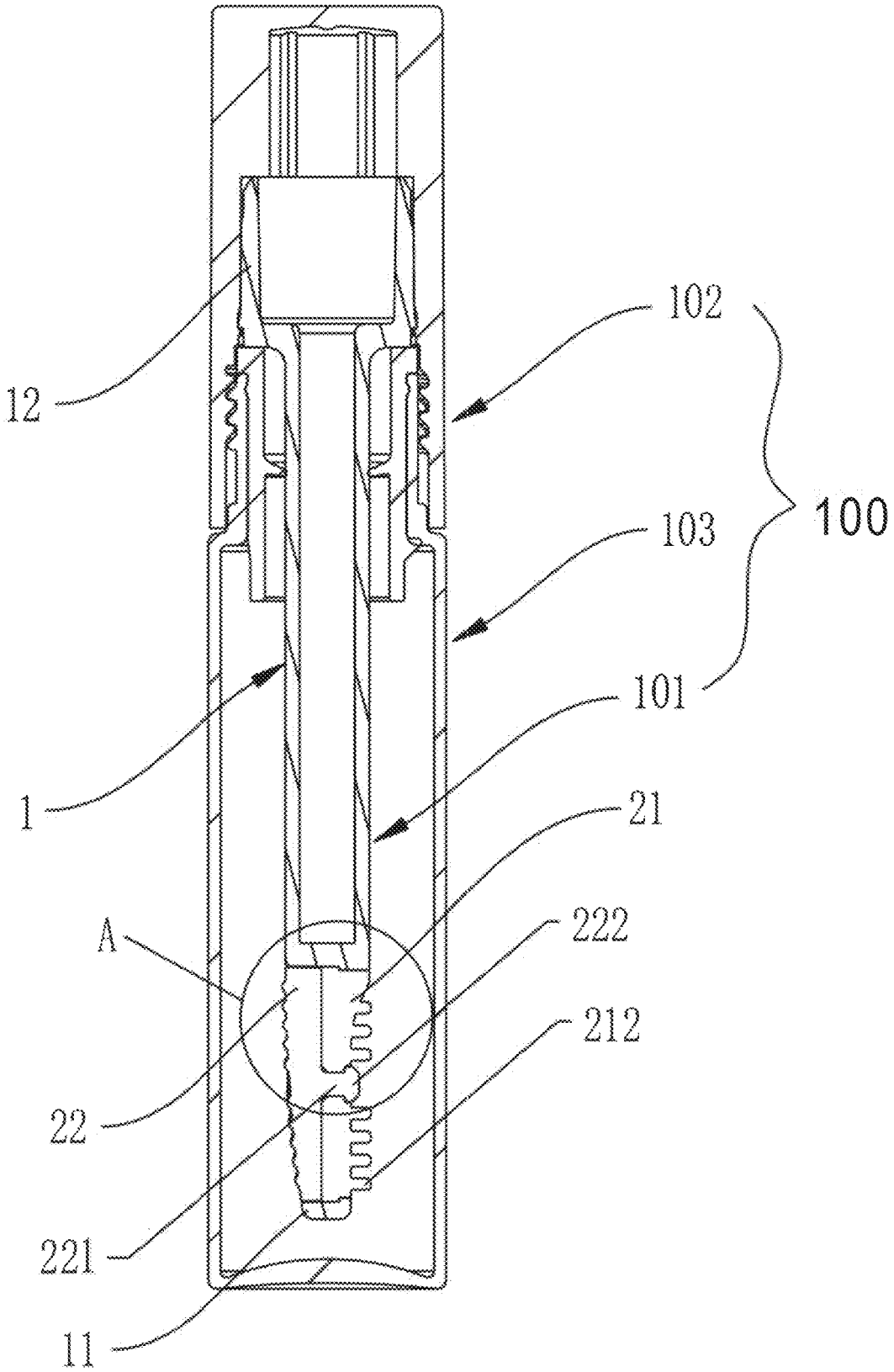
FIG. 2 is a longitudinal cross section view of the cosmetic packaging container of the present embodiment.

The invention relates to a cosmetic packaging container 100, including a cosmetic applicator 101 and a cap body 102, which is shown in FIG. 1 and FIG. 2. The cosmetic applicator 101 comprises a mounting rod 1 and an applicator device 2. The mounting rod 1 has a first end 11 and a second end 12 arranged at two ends of different length directions, the second end 12, or connected end, is connected with the cap body 102, and the applicator device 2 is arranged on the applicator end 11.

The Applicator device 2 includes a first applicator element 21, and a second applicator element 22, the first applicator element 21 having a material hardness less than the second applicator element 22. The first applicator element 21 and the second applicator element 22 are fixed on the first end 11 of the mounting rod 1, and the first applicator element 21 and the second applicator are arranged on different sides of the mounting rod 1. The user can choose the first applicator element 21 or the second applicator element 22 to apply cosmetics according to the needs.

In the present embodiment, the first end 11 has a through opening 111, the first applicator element 21 and the second applicator element 22 are arranged in the through opening 111, and the second applicator element 22 and the first applicator element 21 are connected to each other by a connecting structure. As shown in FIGS. 2 to 8, at least part of the first applicator element 21 extends outward from the through opening 111 and protrudes outward from a first outer surface of first end 11 of the mounting rod, and at least part of the second applicator element 22 extends outward from the through opening 111 and protrudes outward from a second outer surface of the first end 11 for easy smearing by the user.

In this embodiment, the first applicator element 21 is made of a flexible material, which can be deformed to a certain extent during use. When the user applies the cosmetic product using the first applicator element 21, it feels soft and the cosmetic product can be applied against the skin, so that the cosmetics can be applied more efficiently.

In this embodiment, the second applicator element 22 is made of hard material, for example, it can comprise one of Zamac, metal, ceramic, stone and other materials. Such use of a hard materials not only provides different coating feelings, but also, since the second applicator element 22 will not deform, and so that it will not be too thick or too fin because of excessive force, an easy control of the comestic product application. So when the user uses the second applicator element 22 made of metal, ceramic and other materials for applying a cosmetic product, he will also have a cool touch and can reach a massage effect.

In some preferred embodiments, the connection structure consists of a matching connection column 221 and connection aperture 211, one of which is arranged on the first applicator element 21 and the other on the second applicator element 22, and the connection column 221 is inserted in the connection aperture 211.

In the present embodiment, as shown in FIGS. 9 to 12, the connection aperture 211 is arranged on the first applicator element 21 and runs through the first applicator element 21 along its thickness direction, and connection column 221 is arranged on the second applicator element 22 and extends towards the first applicator element 21. In this embodiment, the end of the connection column 221 is provided with a connecting head 222 whose diameter is greater than the diameter of the connection column 221 and the diameter of the connecting head 222 is greater than the aperture of the connection hole 211. Since the first applicator element 21 is made of a flexible material, the connection aperture 211 can be deformed so that the connecting head 222 can protrude from the connection aperture 211 and extend to the side of the first applicator element 21 away from the second applicator element 22, thereby connecting the first applicator element 21 to the second applicator element 22.

In some preferred embodiments, the first applicator element 21 is detachable from the second applicator element 22, and the user can remove the two and replace either, thus enabling the applicator to achieve more apply functions and experiences. In the present embodiment, by connecting the connection column 221 to the connection aperture 211, the connecting head 222 can be separated from the first applicator element 21 and the second applicator element 22 through the connection aperture 211 by applying only a force that drives the first applicator element 21 and the second applicator element 22 in the opposite direction, thus achieving the separation of the first applicator element 21 and the second applicator element 22. In particular, the user can separate the connecting head 222 from the first applicator element 21 by pushing or pressing the connecting head 222 in a direction of the second applicator element 22. In other embodiments, a detachable connection of the first applicator element 21 to the second applicator element 22 may be achieved using other connections in the prior art.

Figure 3:
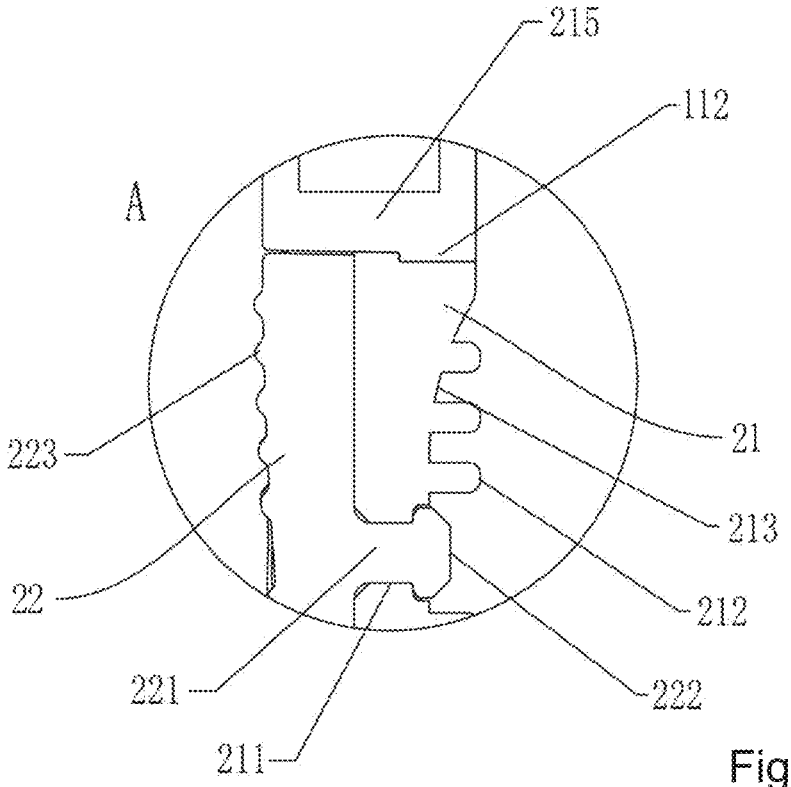
FIG. 3 is the enlarged view of the zone A in attached FIG. 2.
Figure 4:
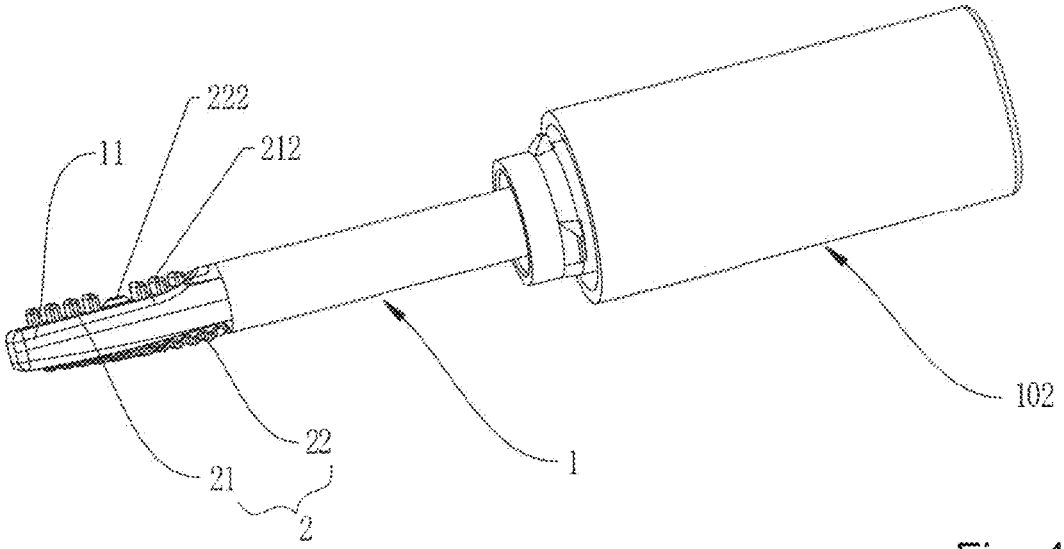
FIG. 4 shows a three-dimensional view of the cap body and the applicator in this embodiment.
Figure 5:
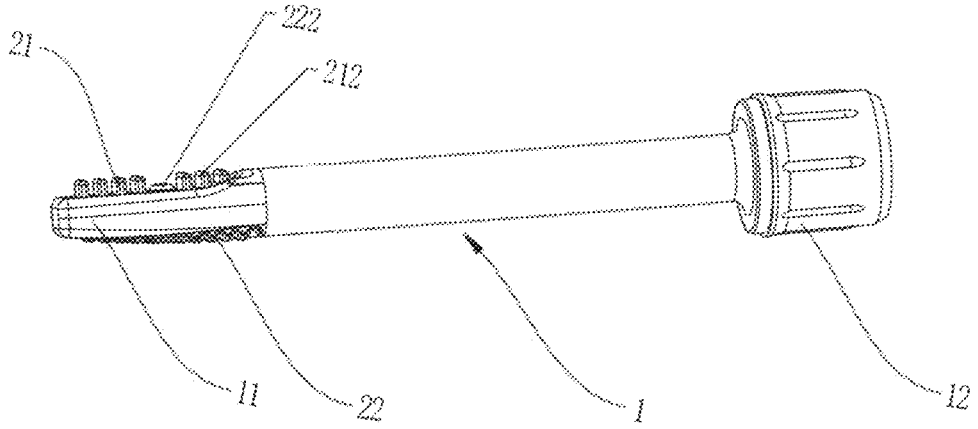
FIG. 5 shows a three-dimensional view of the applicator in the present embodiment.
Figure 6:
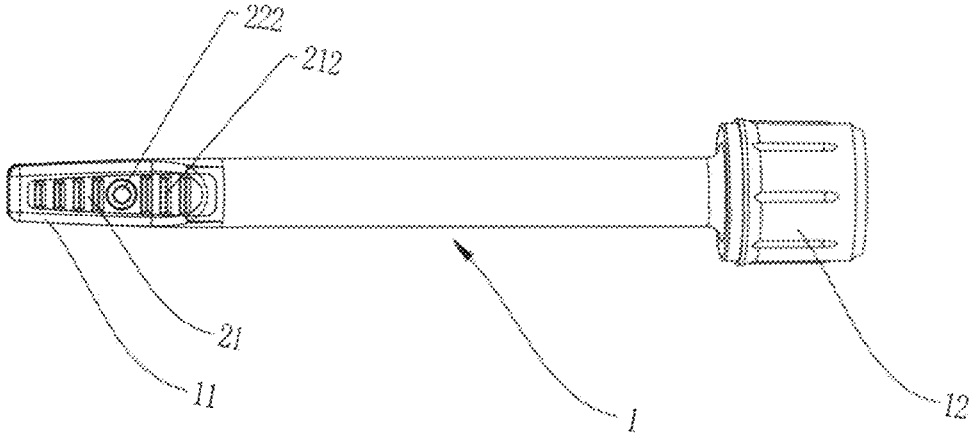
FIG. 6 shows a three-dimensional view of the applicator in the present embodiment under a second perspective.

In the present embodiment, the first applicator pattern 212 is located on the first applicator element 21 on one side away from the second applicator element 22. specifically, the first applicator element 21 has a first substrate, the connection aperture 211 is arranged on the first substrate, the first applicator pattern 212 is arranged on the side of the first substrate away from the second applicator element 22, and the first applicator pattern 212 forms a first applicator surface for applying cosmetics. The connecting head 222 is recessed and spaced from the first applicator pattern 212, i.e. the connecting head 222 does not protrude outside the first applicator pattern 212. In this way, the connecting head 222 is located between the first substrate and the coating surface defined by the top of the first applicator pattern 212, and there is provided a spacing between the connecting head 222 and the coating surface. As shown in FIGS. 2 and 3, the first applicator pattern 212 includes arranged at intervals along the length direction of the first applicator element 21, and the first applicator pattern 212 protrudes in a direction away from the first applicator element 21. All the free ends of the first applicator pattern 212 constitute the first applicator surface. Along the extension direction of the first applicator pattern 212, the free end of the first applicator pattern 212 exceeds the connecting head 222, so that the connecting head 222 will not affect the application of cosmetic product by the first applicator element 21. In this wat, it is avoided the user's skin to contact both the first applicator element 21 and the connecting head 222 at the same time, affecting the application effect, and causing discomfort to the user's application from the difference in hardness of the first applicator element 21 and the connecting head 222.

The first applicator pattern 212 includes ribs arranged at intervals along the length direction of the first applicator element 21.

In this embodiment, the mounting rod 1 is made of a hard material, the first applicator element 21 and the mounting rod 1 are formed in one piece, and in some embodiments, the first applicator element 21 is fixed to the mounting rod 1. Thus, the first applicator element 21 is not replaceable, but the second applicator element 22 can be replaced by removing the second applicator element 22 from the first applicator element 21. By fixing the first applicator element 21, the stability of the applicator 2 is improved to prevent the deformation or even falling of the applicator device 2 relative to the mounting rod 1 when applying cosmetics due to the wear from use.

As shown in FIG. 3, in the present embodiment, a limiting tab 112 is arranged in the through opening 111, and the limit tab 112 is located on the side wall of the through opening 111 and is in a ring shape. The first applicator element 21 has a limiting section 215, and the limiting section 215 and the first applicator element 21 are arranged on two sides of the thickness direction of the first applicator element 21. The size of the limit part 215 is larger than the rest of the first applicator element 21, so that the cross-section of the first applicator element 21 is stepped. When the first applicator element 21 is located in the through opening 111, the limiting tab 112 and the limiting section 215 lean against each other, improving the stability of the first applicator element 21 relative to the mounting rod 1.

In other embodiments, the first applicator element 21 is removably mounted to the mounting rod 1, and the first applicator element 21 is also detachable and replaceable from the mounting rod 1, enriching the functionality of the cosmetic applicator 101 according to the invention.

In this embodiment, the first applicator element 21 has a first plane 214 facing the second applicator element 22, the second applicator element 22 has a second plane 224 facing the first applicator element 21. The first plane 214 and the first applicator surface are on opposite sides of the thickness direction of the first applicator element 21. The second plane 224 and the second applicator surface are arranged on opposite sides of the thickness direction of the second applicator element 22. The first plane 214 and the second plane 224 fit each other, or in other words are complementary in shape, so that the two can be relatively stable, to avoid the relative movement of the two, affecting the use of users.

Figure 9:
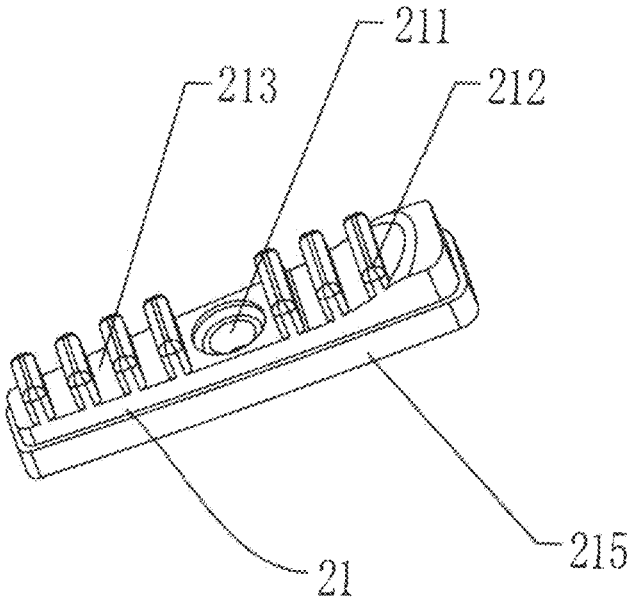
FIG. 9 is a three-dimensional view of the first applicator element of the present embodiment.
Figure 11:
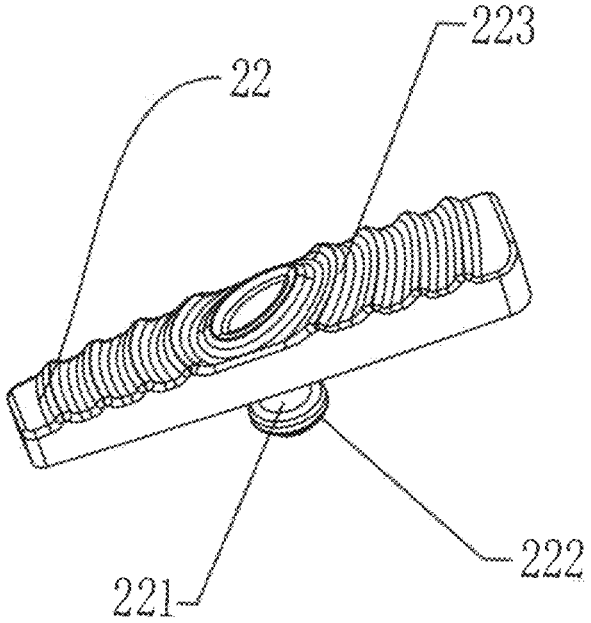
FIG. 11 is a three-dimensional view of the second applicator element of the present embodiment.
Figure 12:
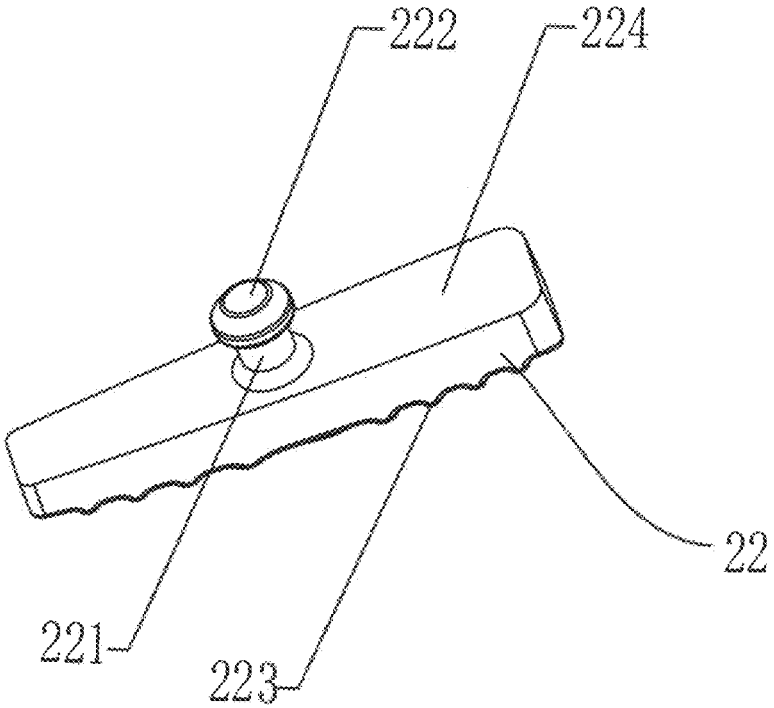
FIG. 12 is a three-dimensional view of the second applicator element of FIG. 11 from another perspective.
Figure 19A:
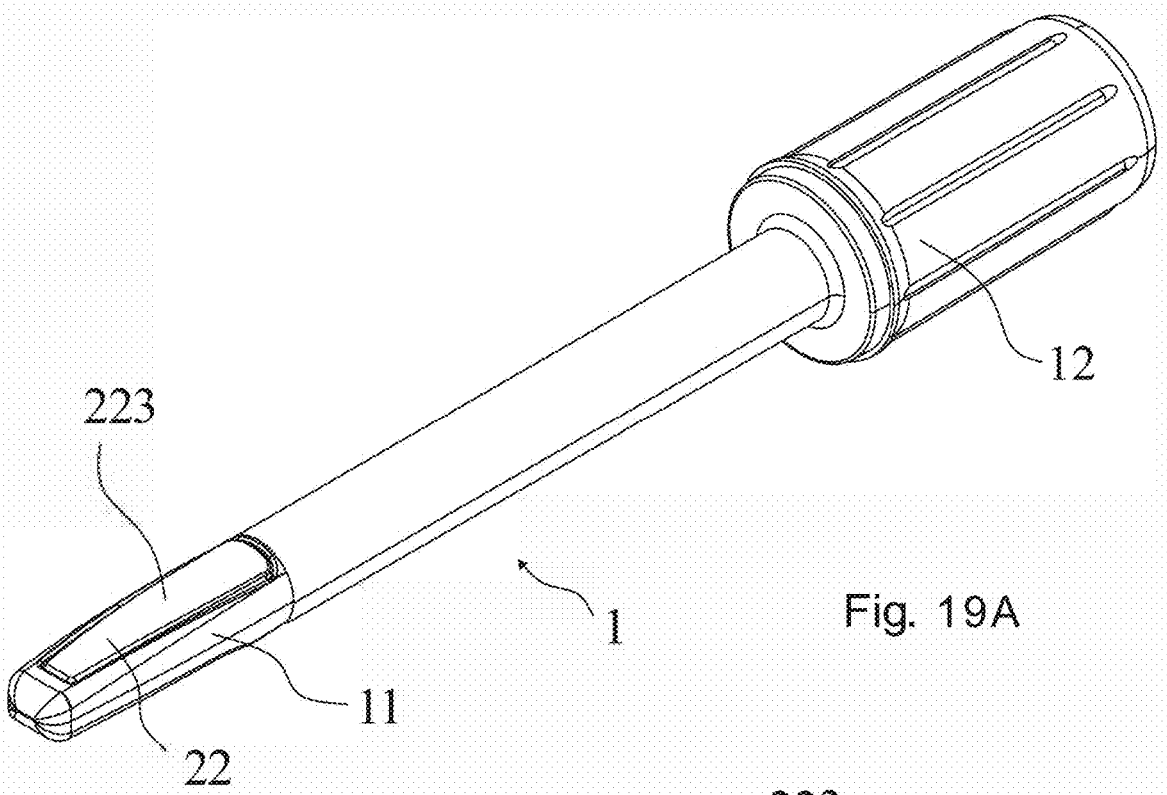
FIGS. 19A to 19C are respectively a three-dimensional view of a cosmetic applicator including a third alternative for a second applicator element according to the first embodiment, a view from above of this second applicator element and a close three-dimensional view of this second applicator element.
Figure 19B:
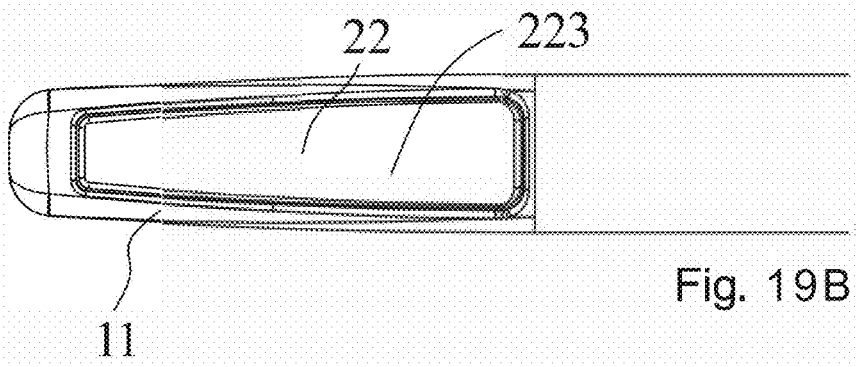
Figure 19C:
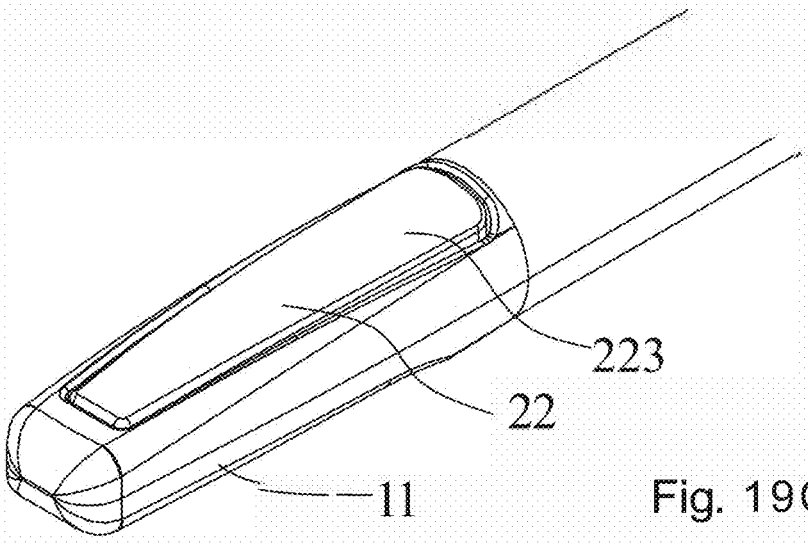

In this embodiment, the second applicator element 22 includes a second applicator pattern 223. The second applicator pattern 223 includes ribs arranged at intervals along the length direction of the second applicator element 22. The ribs are arranged to allow more retention of the cosmetic product, and the ribs may be linear, curved or other shapes to provide different tactile sensations. In this embodiment, as shown in FIG. 9 and FIG. 11, the first applicator pattern 212 includes linear ribs, and the second applicator pattern 223 includes arc-shaped ribs. In other embodiments, as the one that will be described in association FIGS. 19A to 19C, the first or second applicator pattern 222, 223 may be a smooth surface, capable of providing a smooth touch.

In some preferred embodiments, the first applicator element 21 has a first substrate. One side of the first substrate has a first arc surface 213, the first arc-shaped surface 213 is recessed, or hollowed-out, radially along the mounting rod 1. The first applicator pattern 212 is arranged on the first arc-shaped surface 213. Specifically, the first applicator pattern 212 extends from the first arc surface 213 in a direction away from a first applicator element 21. In some embodiments, the first arc surface 213 is the first applicator element, or the first arc surface 213 is an integral part of the first applicator element. When used, the concavity of the first arc surface can better fit some parts of the skin, such as lips, making the application more effective.

In some preferred embodiments, the second applicator element 22 has a second substrate, one side of the second substrate has a second arc surface, the arc curved surface protrudes radially along the mounting rod 1, the second applicator patent is arranged on the second curved surface. In particular, the second applicator patten includes ribs protruding from the second arc face in a direction away from the second applicator element 22. In some embodiments, the second arc surface is the second applicator element, or the second curved surface is an integral part of the second applicator element. The convex shape can also be used for applying some special part of the skin of the user and can also be used for applying the cosmetic product with some special shapes.

The cosmetic packaging container 100 also includes a bottle body 103, which has a containing cavity for filling cosmetic product, and a cap body 102 that can be covering the bottle body 103 in a coordinated way. When the cap body 102 is covered on the bottle body 103, the cosmetic applicator 101 is housing in the containing cavity. When the user open and remove the cover 102, so that the cosmetic applicator 101 can be drawn out from the containing cavity, and then the application operation can be carried out. During use, the first end 11 of the mounting rod 1 can be extended into the containing cavity for dipping cosmetics.

Figure 8:
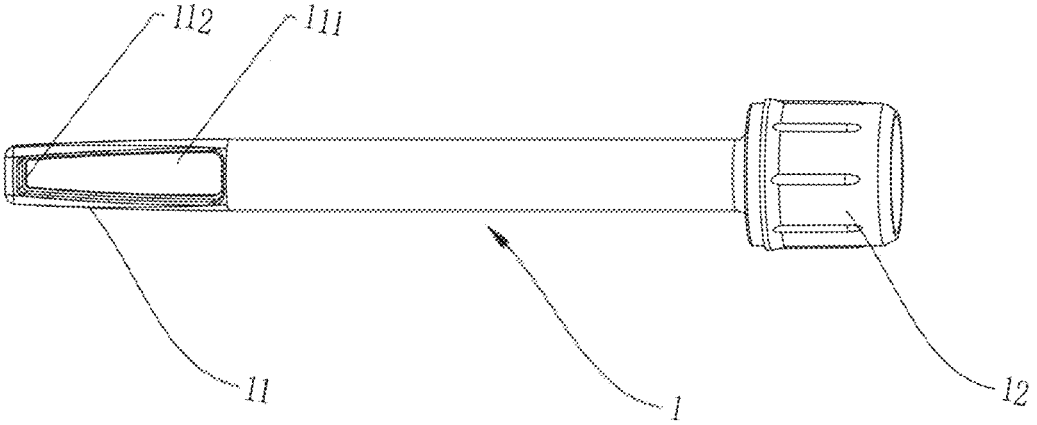
FIG. 8 is a three-dimensional view of an installation rod of the present embodiment.
Figure 10:
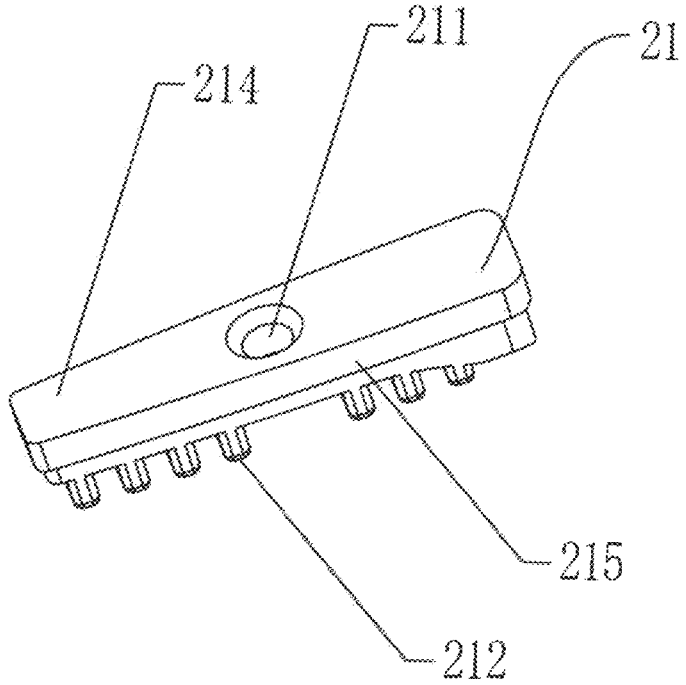
FIG. 10 is a three-dimensional view of the first applicator element of FIG. 9 from another perspective.
Figure 13A:
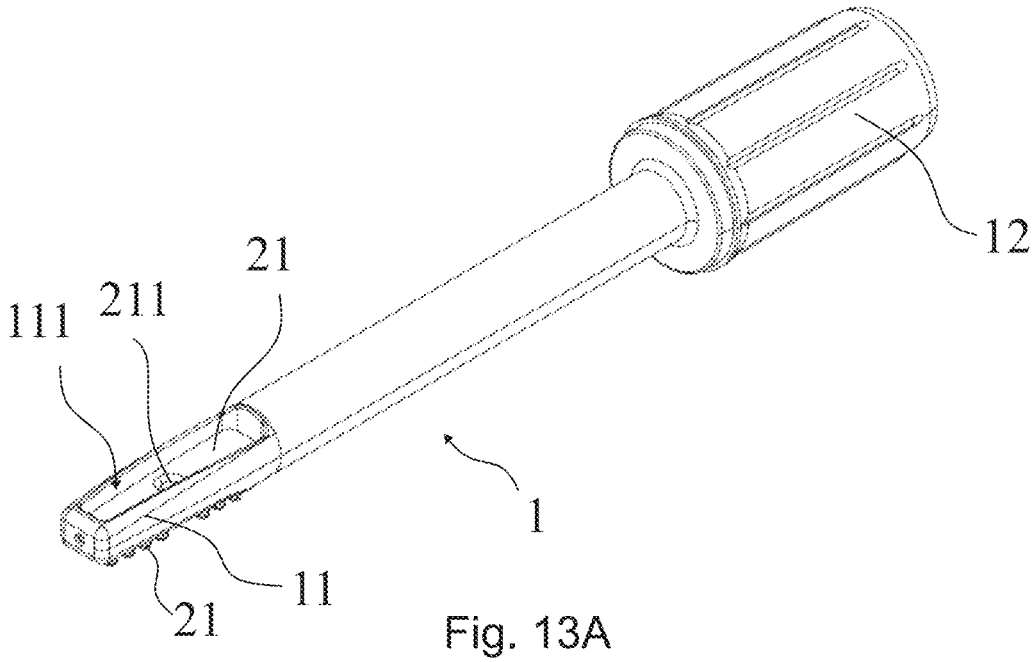
FIGS. 13A and 13B are respectively three-dimensional views of the mounting rod and the first applicator element integral to each other and the mounting operation of the second applicator element on the first applicator in a through opening of the mounting rod.
Figure 13B:
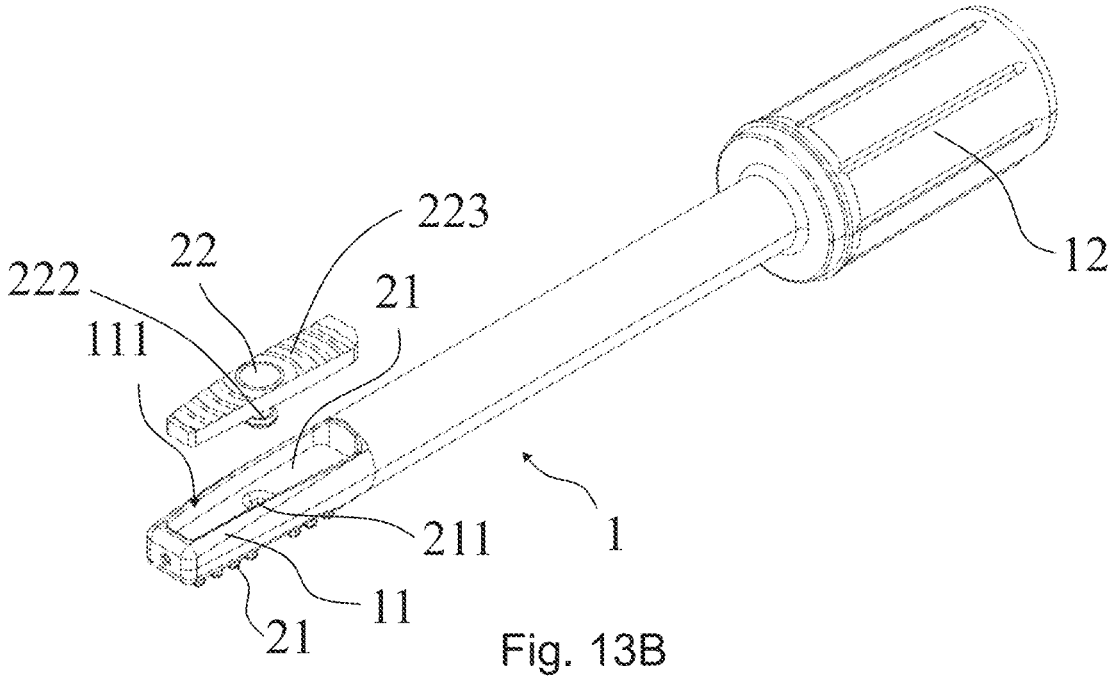

If FIG. 8 and FIGS. 9 to 10 show respectively the mounting rod 1 and the first applicator element 21 independent from each other, in the present embodiment, as shown on FIGS. 13A and 13B, the mounting rod and the first applicator element are integral to each other. Indeed, as shown on FIG. 13A, the first applicator element 21 is integral with the end 11 of the mounting rod 1. To obtain such configuration, the mounting rod 1 and the applicator element 21 could be made by co-molding. As an alternative, the first applicator element could be molded in the through opening 111. Eventually, in other embodiments, has shown on FIG. 8 and FIGS. 9 to 10.

Figure 14A:
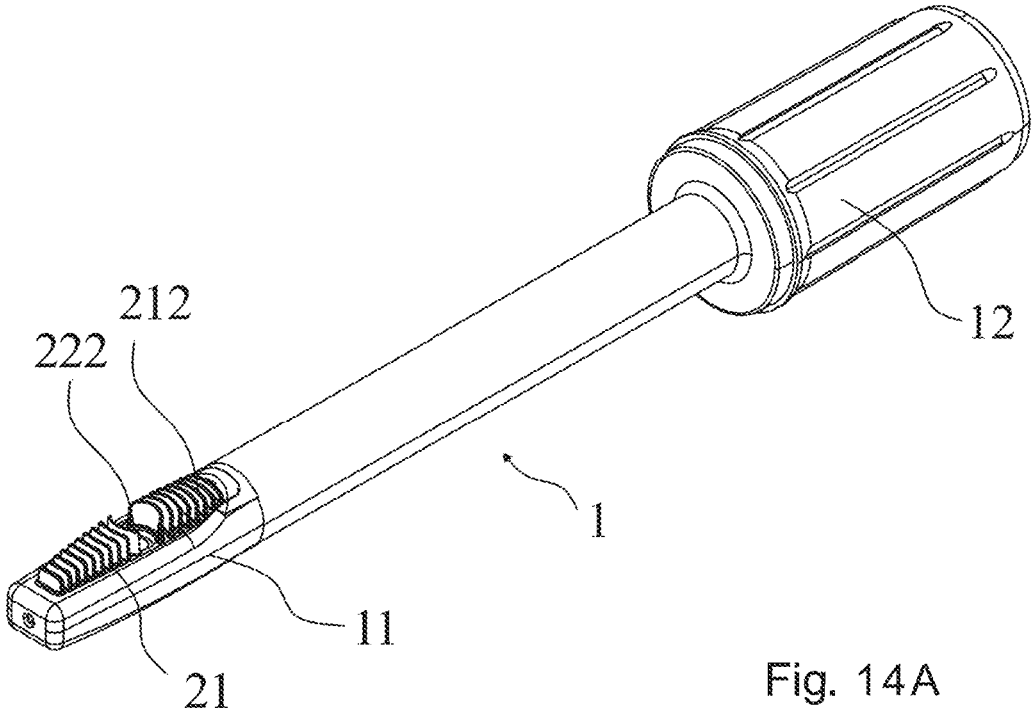
FIGS. 14A to 14C are respectively a three-dimensional view of a cosmetic applicator including a first alternative for a first applicator element according to the first embodiment, a view from above of this first applicator element and a close three-dimensional view of this first applicator element.
Figure 14B:
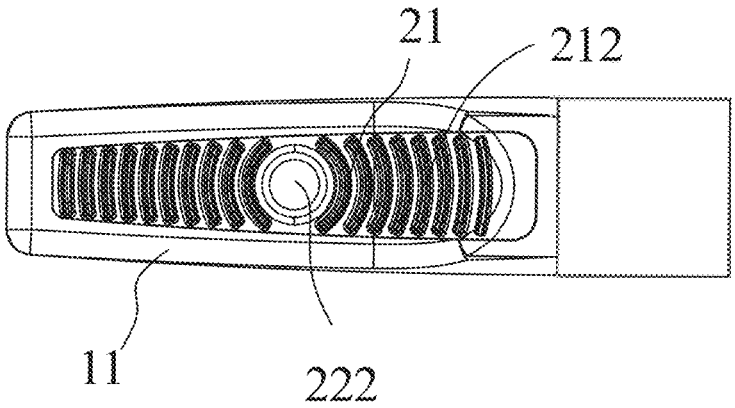
Figure 14C:
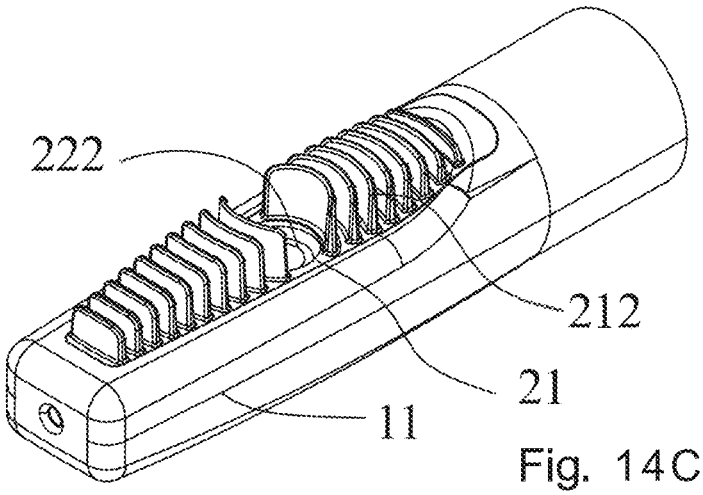
Figure 15A:
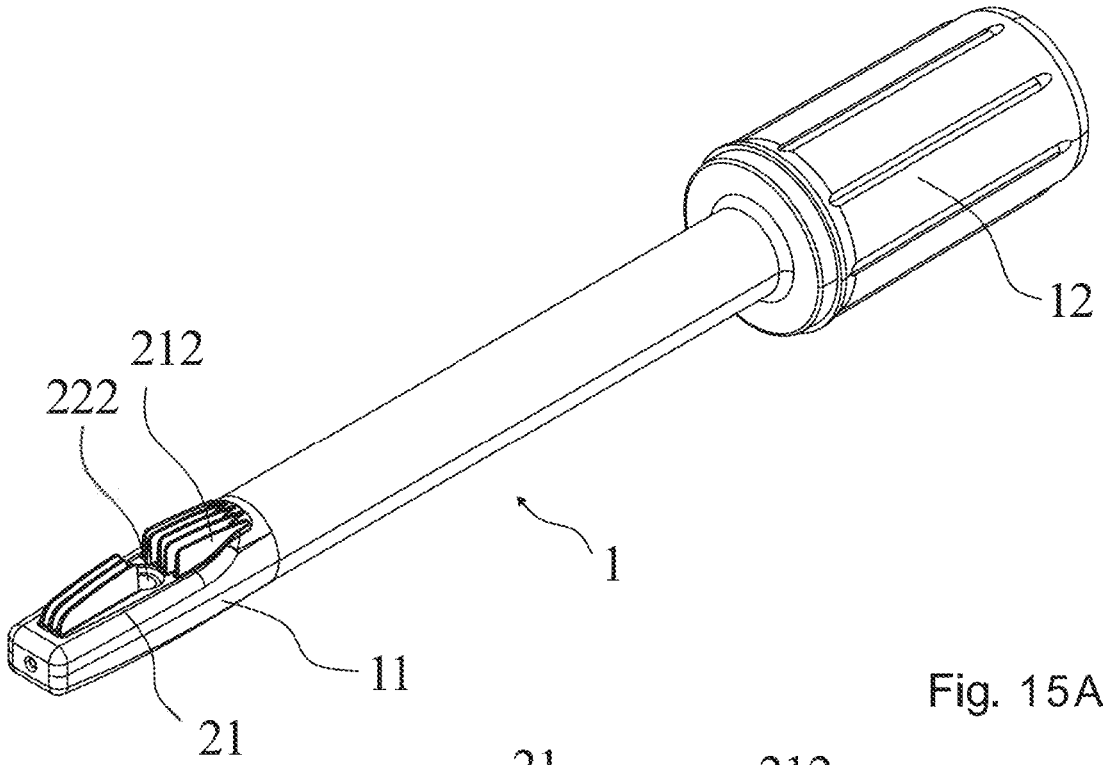
FIGS. 15A to 15C are respectively a three-dimensional view of a cosmetic applicator including a second alternative for a first applicator element according to the first embodiment, a view from above of this first applicator element and a close three-dimensional view of this first applicator element.
Figure 15B:
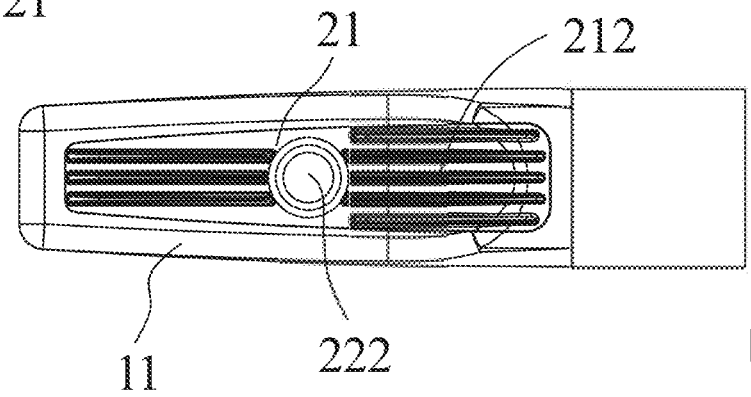
Figure 15C:
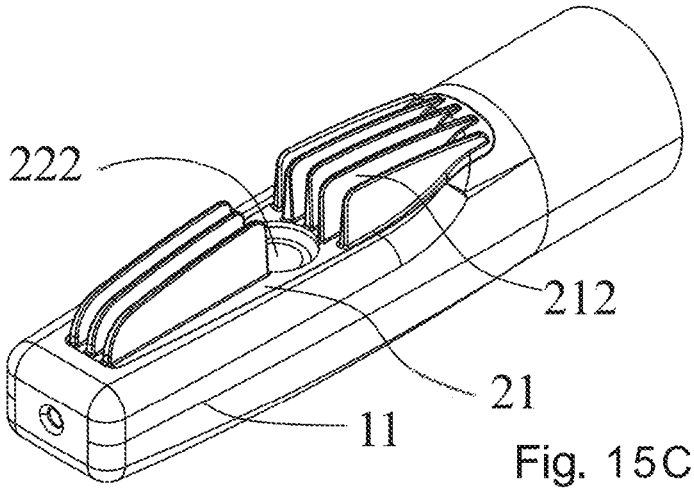
Figure 16A:
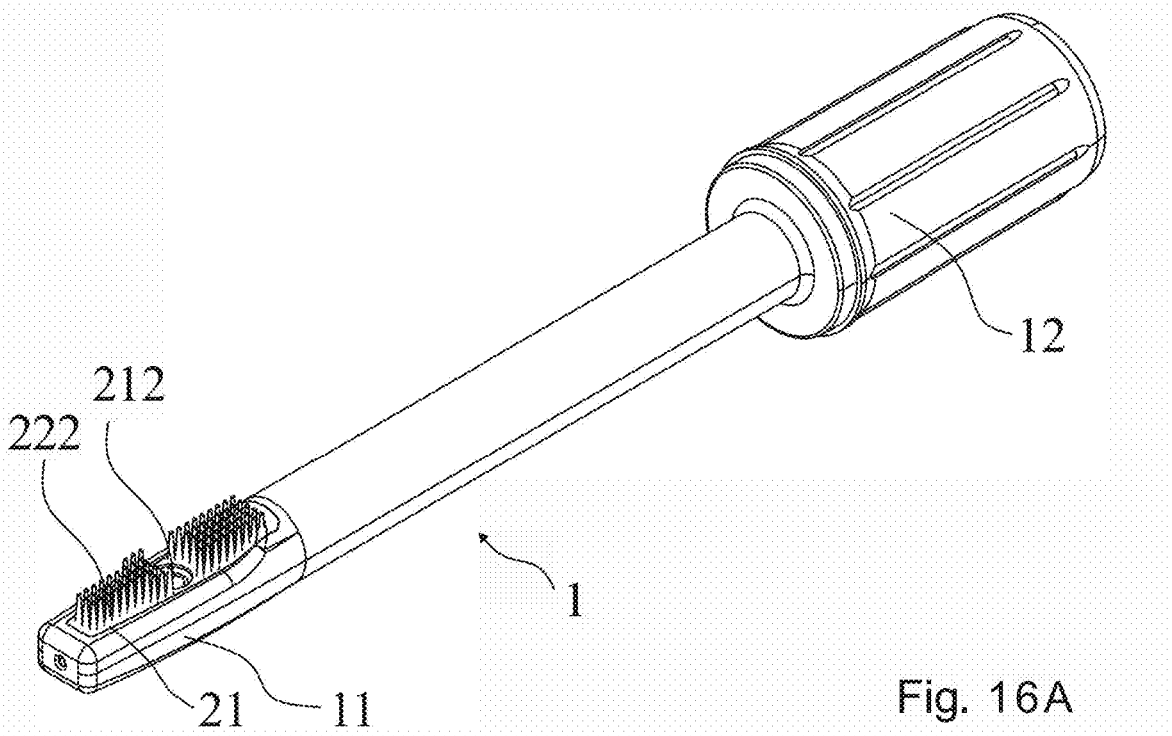
FIGS. 16A to 16C are respectively a three-dimensional view of a cosmetic applicator including a third alternative for a first applicator element according to the first embodiment, a view from above of this first applicator element and a close three-dimensional view of this first applicator element.
Figure 16B:
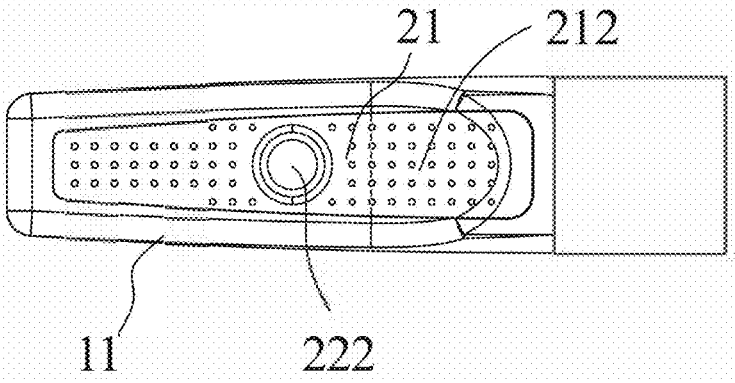
Figure 16C:
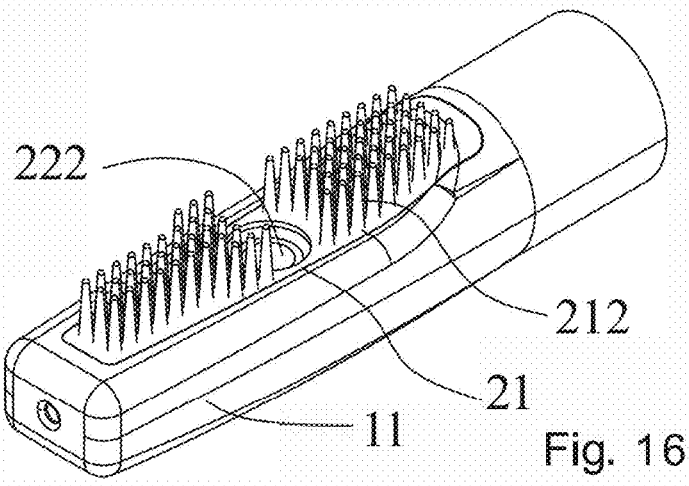

FIGS. 14A to 19C provide examples of alternative first and second applicator patterns 212, 223 encompassed by the invention. More specifically, FIGS. 14A to 14C shows that, as an alternative to the first applicator pattern 212 of FIGS. 6 and 9, the first applicator element 21 could include, as a first applicator pattern 212 curved ribs, the proximal ribs to the connection aperture 211 being curved in such was to be essentially parallel to the connection aperture 211, the distal ribs to the connection aperture 211 being linear and essentially transversal to the longitudinal direction of the first applicator element 21. FIGS. 15A to 15C shows that the first applicator pattern 212 could also include longitudinal ribs. As shown on FIG. 16A to 16C, as an alternative to ribs, the first applicator pattern 212 could also comprise an array of bristles.

Figure 7:
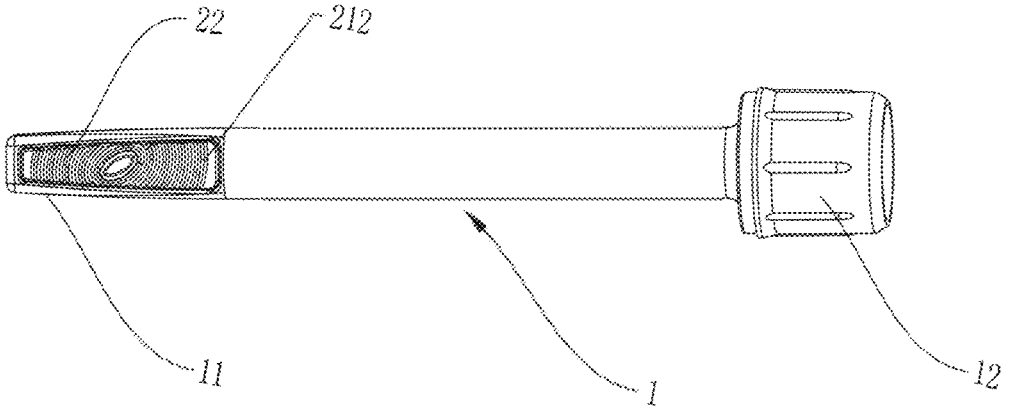
FIG. 7 shows a three-dimensional view of the applicator in the present embodiment under a third perspective.
Figure 17A:
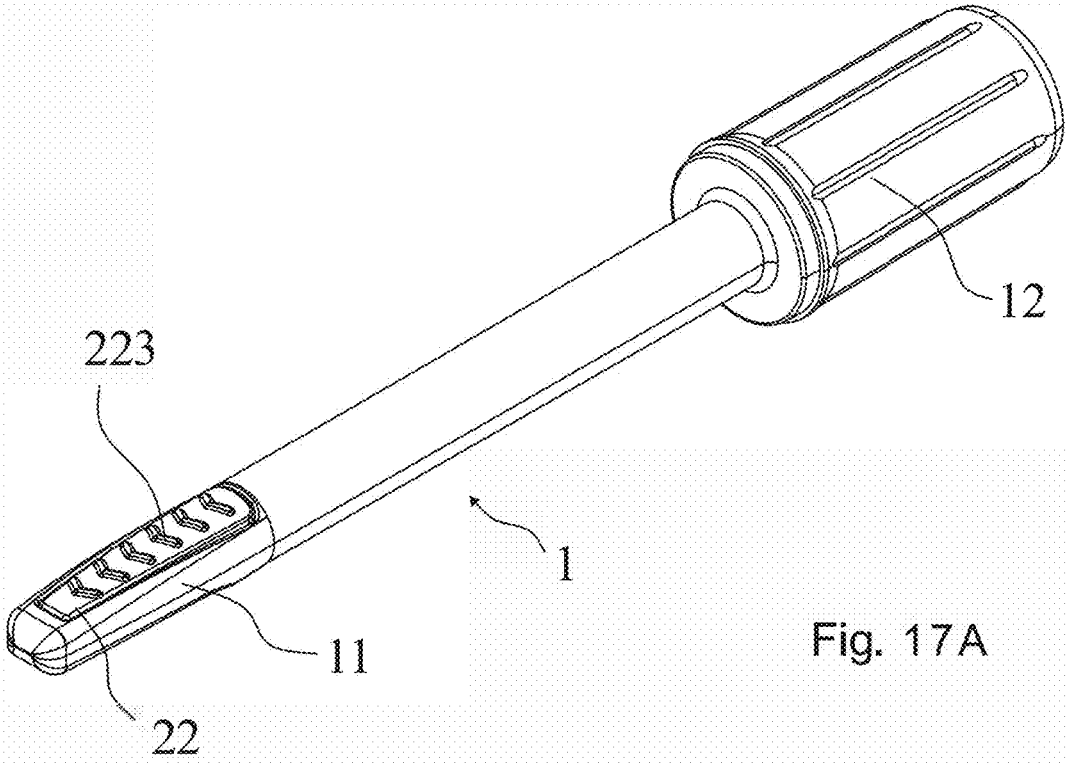
FIGS. 17A to 17C are respectively a three-dimensional view of a cosmetic applicator including a first alternative for a second applicator element according to the first embodiment, a view from above of this second applicator element and a close three-dimensional view of this second applicator element.
Figure 17B:
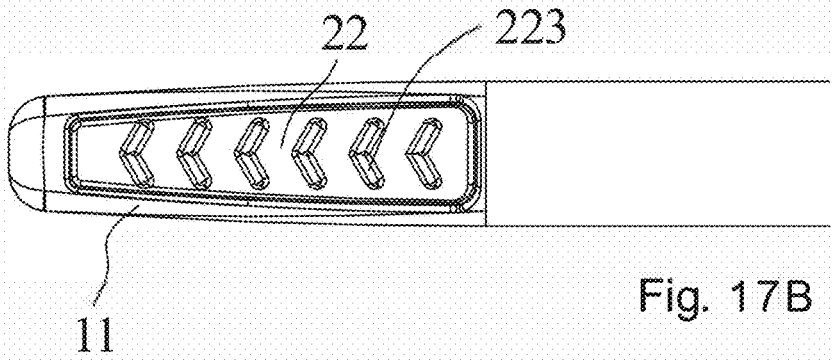
Figure 17C:
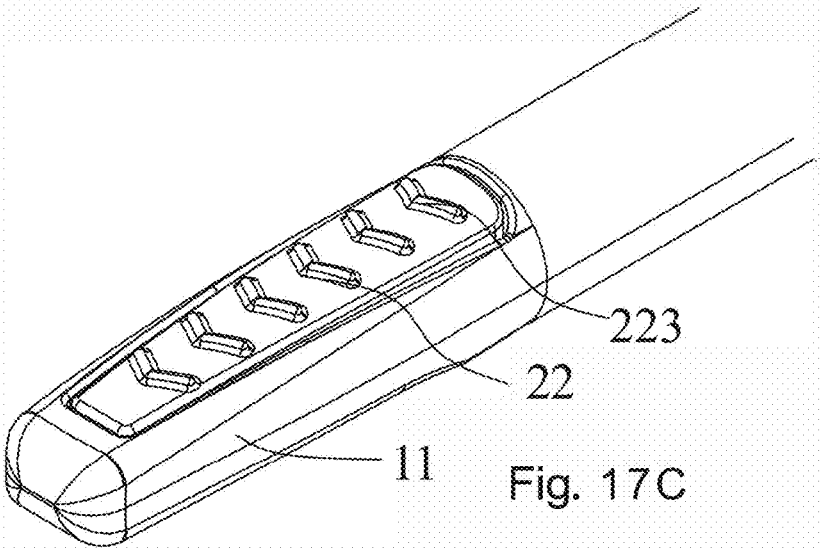
Figure 18A:
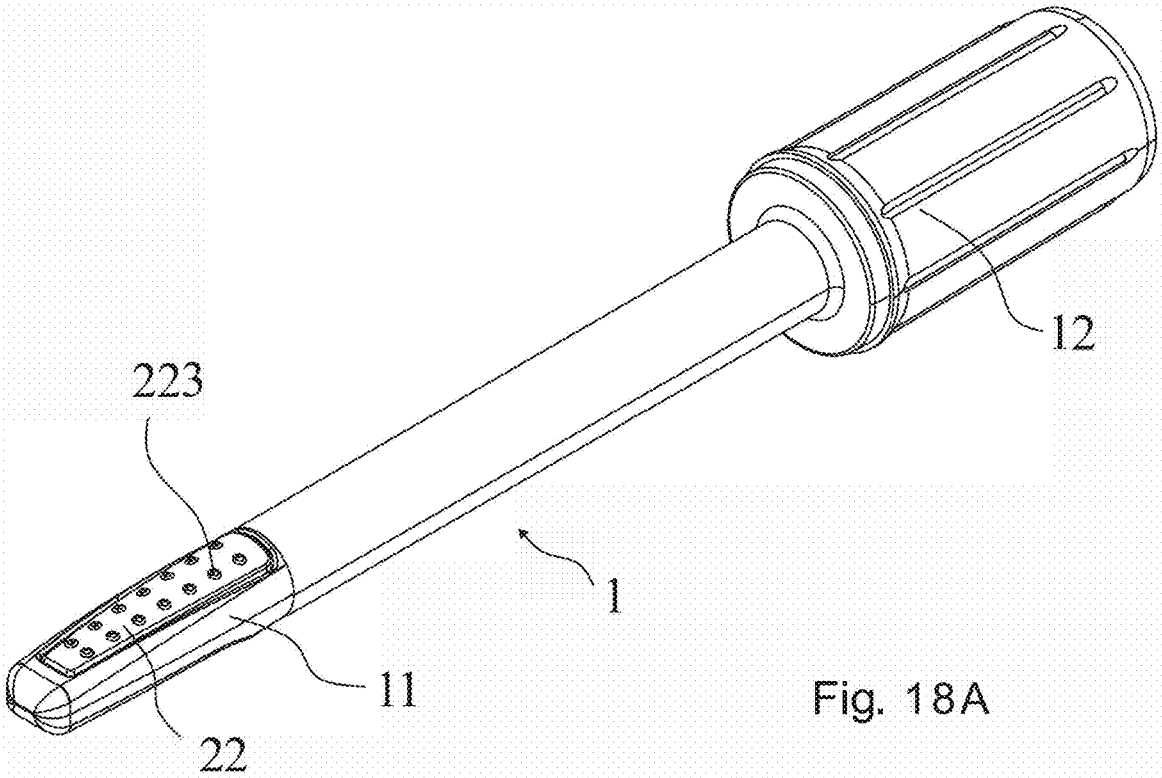
FIGS. 18A to 18C are respectively a three-dimensional view of a cosmetic applicator including a second alternative for a second applicator element according to the first embodiment, a view from above of this second applicator element and a close three-dimensional view of this second applicator element.
Figure 18B:
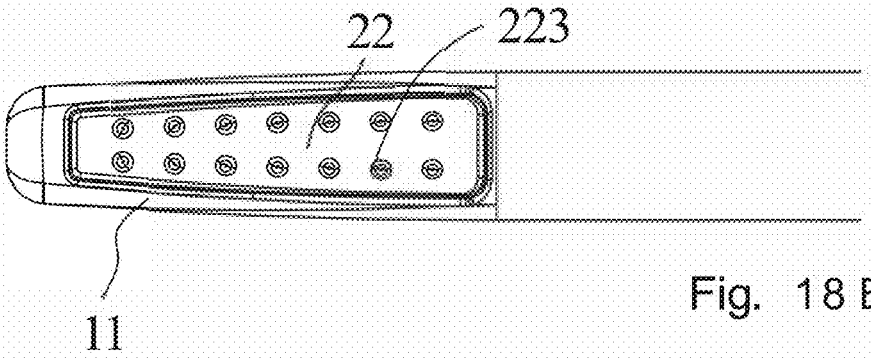
Figure 18C:
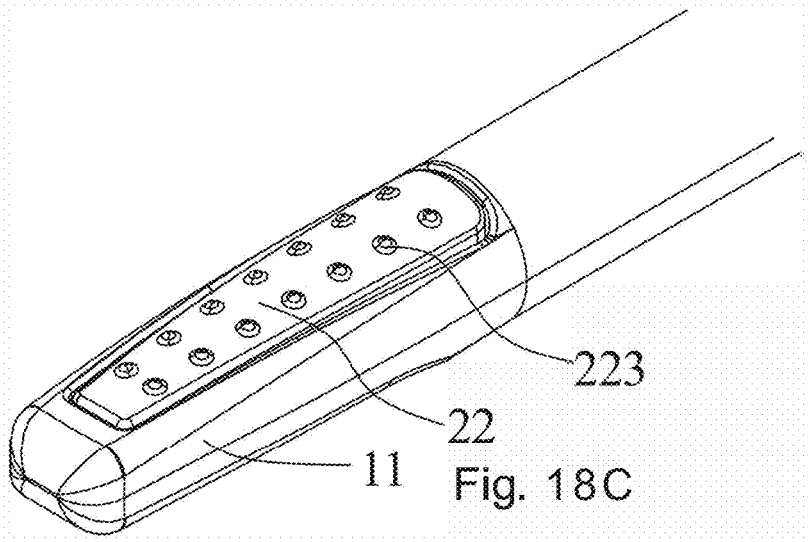

Regarding the second applicator pattern 223, FIGS. 17A to 17C shows that, instead of the curved ribs (or curved corrugation) of FIGS. 7 and 11, the second applicator pattern 223 could include parallel ribs with a V-shaped pattern (or a chevron shape). As another alternative, the second pattern applicator 223 could comprise, as shown on FIG. 18A to 18C an array of studs. Similarly, and finally, as shown on FIGS. 19A to 19C, the second applicator pattern 223 could also take the form of a concave surface, i.e. the form of the second arc surface.

In summary, the cosmetic applicator 101 of the present embodiment is provided with a first applicator element 21 made of flexible material and a second applicator element 22 made of hard material. The two applicators of different materials can produce different applicator effects, and at the same time can give the user different applicator experiences. The second applicator element 22 also has cooling and massage. Users can choose suitable applicators for makeup according to different needs. At the same time, the user can separate and replace the second applicator element 22 with the first applicator element 21, so that more functions can be realized, and more applied experience can be obtained.

DRAWING NUMERICAL REFERENCE

100, cosmetic packaging containers; 101, cosmetic applicator; 102, cap body; 103, bottle body; 1, mounting rod; 11, first end of the mounting rod; 111, through opening; 112, limiting tab; 12, second end of the mounting rod; 2. applicator device; 21, the first applicator element; 211, connection aperture; 212, the first applicator pattern; 213, the first arc surface; 214, the first plane; 215, limiting section; 22, the second applicator element; 221, connection column; 222, connecting head; 223, the second applicator pattern; 224, the second plane.

The invention claimed is:

1. A cosmetic applicator comprising:

a mounting rod and, an applicator device arranged at an end of the mounting rod, wherein the applicator device comprises a first applicator element having a first applicator surface for applying cosmetic products and a second applicator element having a second applicator surface for applying cosmetic products, the first applicator surface being opposite to the second applicator element and the second applicator surface being opposite to the first applicator element, wherein the first applicator element includes a first material, and the second applicator element includes a second material, the first material having a hardness lower than the hardness of the second material, and wherein the first applicator element and the second applicator element are fixed on the end of the mounting rod at different sides of the mounting rod, wherein the first material is a flexible material whereas the second material is a rigid material, and wherein the second applicator element is removably mounted on the end of the mounting rod, wherein the end of the mounting rod includes a through opening and wherein the first applicator element and the second applicator element are at least partially arranged in the through opening and are connected by a connection structure passing through the through opening, the connection structure including a connection column and a connection aperture, wherein the first applicator element includes the connection aperture, wherein the second applicator element includes the connection column, an end of the connection column including a connecting head, a diameter of the connecting head being greater than a diameter of the connection column and a diameter of the connection aperture, and wherein the connection column extends through the connection aperture with the connecting head arranged on the side of the first applicator element opposite the rest of the second applicator element.

2. The cosmetic applicator according to claim 1, wherein the first applicator element is integral with the end of the mounting rod.

3. The cosmetic applicator according to claim 1, wherein the first applicator element is removably mounted on the end of the mounting rod.

4. The cosmetic applicator according to claim 3, wherein a side of the first substrate has a first arc surface which is hollowed-out, the first applicator pattern extending from the first arc surface in direction opposite from the first substrate, and/or wherein one side of the second substrate has a second arc surface protruding in an outside direction from the second substrate, the second applicator pattern extending from the second arc surface in direction opposite from the second substrate, the second applicator pattern including a plurality of intervals arranged along a length direction of the second applicator element.

5. The cosmetic applicator according to claim 1, wherein the first applicator element includes a first substrate, the connection aperture being provided through the first substrate, a first applicator pattern being arranged on the first substrate opposite to the second applicator element, the first applicator pattern forming the first applicator surface, wherein the connecting head is recessed and spaced from the first applicator pattern.

6. The cosmetic applicator according to claim 1, wherein the first applicator element includes a first substrate, a side of the first substrate having a first are surface which is hollowed-out, the first applicator element further including at least a first applicator pattern extending from the first arc surface in direction opposite from the first substrate, and/or second applicator element includes a second substrate, one side of the second substrate having a second arc surface protruding in an outside direction from the second substrate, the second applicator element further including a second applicator pattern extending from the second arc surface in direction opposite from the second substrate, the second applicator pattern including a plurality of intervals arranged along a length direction of the second applicator element.

7. The cosmetic applicator according to claim 6, wherein the first applicator element is removably connected to the second applicator element.

8. The cosmetic applicator according to claim 1, wherein at least a part of the first applicator element extends outside the through opening and protrudes away from a first exterior surface of the end of the mounting rod, and wherein at least a part of the second applicator element extends outside the through opening and protrudes away from a second exterior surface of the end of the mounting rod.

9. The cosmetic applicator according to claim 1, wherein the first applicator element has a first plane oriented toward the second applicator element, the second applicator element having a second plane oriented toward the first applicator element, wherein a first applicator surface and the first plane are arranged on two sides of the first applicator element relative to a thickness direction of the first applicator element, and wherein the second applicator surface and the second plane are arranged on two sides of the second applicator element relative to a thickness direction of the second applicator element, the first plane and the second plane being complementary in shape.

10. Cosmetic packaging containers comprising:

a cosmetic applicator according to claim 1, and a bottle body intended to accommodate a cosmetic product.

* * * * *